United States Patent [19]

Miyamoto

[11] 4,237,682

[45] Dec. 9, 1980

[54] OPEN-END ROTOR FOR A SPINNING MACHINE

[75] Inventor: Noriaki Miyamoto, Kariya, Japan

[73] Assignee: Kabushiki Kaisha Toyoda Jidoshokki Seisakusho, Kariya, Japan

[21] Appl. No.: 20,233

[22] Filed: Mar. 13, 1979

[30] Foreign Application Priority Data

Mar. 20, 1978 [JP] Japan ..... 53-32208

[51] Int. Cl.[3] ..... D01H 1/135

[52] U.S. Cl. ..... 57/58.89

[58] Field of Search ..... 57/58.89–58.95

[56] References Cited

U.S. PATENT DOCUMENTS

| | | | |
|---|---|---|---|
| 3,520,122 | 7/1970 | Shepherd | 57/58.89 |
| 3,812,667 | 5/1974 | Marsalek et al. | 57/58.89 |
| 3,822,541 | 7/1974 | Croasdale et al. | 57/58.89 |
| 4,058,964 | 11/1977 | Stalder | 57/58.89 |

FOREIGN PATENT DOCUMENTS 52-12292 6/1977 Japan .

*Primary Examiner*—John Petrakes

*Attorney, Agent, or Firm*—Wenderoth, Lind & Ponack

[57] ABSTRACT

An open end rotor for a spinning machine generally comprises a rotary chamber with an open end and an opposite closed end, a first annular wall extending from the open end radially outwardly from a rotational axis and toward the closed end, and a second annular wall extending from the closed end radially outwardly from the rotational axis and toward the first wall to define a fibre collecting space. The first wall comprises an inner portion forming an angle of 55° to 75° with a horizontal plane, and an outer portion. A straight line extending from the outer portion forms an angle of 10° to 35° with the inner portion. The second wall comprises an inner portion extending from the closed end, and an outer portion forming an angle of 20° to 50° with a straight line extending from the inner portion of the second wall. The outer portions of the first and second wall define therebetween the fibre collecting space.

5 Claims, 9 Drawing Figures

OPEN-END ROTOR FOR A SPINNING MACHINE

BACKGROUND OF THE INVENTION

This invention relates to an open end spinning rotor for a spinning machine, which rotor has a self-cleaning capability.

As is known, the rotor for an open end spinning machine is generally provided with an annular wall surface which extends from the rim of an open end of the rotor radially outwardly from the rotary axis and downwards to a region of maximum diameter, where a fibre collecting surface is formed into which the fibres are collected. Open end spinning machines employing the abovementioned rotors are broadly in use for the mass production of yarn and are highly required to be capable of continuous high speed spinning operation for a long duration. However, the spinning rotors in the open end spinning machine are in fact supplied with separated fibres, which more or less contain a certain amount of small impurities, such as, dust, husks and the like. Even if such impurities entering the spinning rotor with the fibres are rolled in the yarn, there will be no influence upon the yarn quality, because critical impurities such as causing yarn breakage have been removed before entering the spinning rotor. However, the spinning rotor faces a serious problem which must be settled in order to allow it to continuously operate at a high speed for a long duration.

In the open end spinning machine, since the fibres are fed into the spinning rotor in the separated or opened state, the impurities mixed with the fibres can move under conditions such that they are substantially released from restriction by the separated fibres. The impurities once separated from the fibres are difficult to re-mix with the fibres which have been deposited in the fibre collecting region of the spinning rotor in the form of a sliver or fibre ring, because of the differences in properties and configuration between the impurities and fibres. That is, the impurities generally have a greater mass than the fibres and therefore they are caused to move into the fibre collecting groove by the action of centrifugal force, which is stronger than that applied to the fibers, with the result that the impurities are deposited and accumulated in the region of maximum diameter or narrowest portion of the fibre collecting groove, while the fibres are positioned on the inner side of the impurities, i.e., on the side adjacent to the rotation axis of spinning rotor. Therefore, when the fibres are removed by twisting them into a tail end of a yarn, it is difficult to cause the impurities on the outer side to be rolled into the twisted yarn, especially where the impurities resemble a cubic shape. The impurities thus remaining in the region of maximum diameter of the fibre collecting groove are compressed by the strong action of centrifugal force and gradually develop into a layer of deposition having a considerable thickness during a long duration of the spinning operation, causing the radius of the maximum diameter region to become larger than the initial most favourable radius. The fibre ring in the fibre collecting groove becomes expanded in width and is subject to a smaller twisting action. This seriously affects the spun yarn so as to invite yarn irregularities, smaller yarn twist and decreased yarn strength, resulting in a poor yarn quality. It is of course essential for the high speed open end spinning operation to apply a sufficient twisting action to the fibre ring and therefore a loss of twist due to the deposition of the impurities makes it difficult to carry out the high speed spinning.

In order to allow the continuous high speed spinning operation for a long duration without causing a quality reduction, it is understood from the foregoing that the impurities must be prevented from being deposited and accumulated in the maximum diameter region on the outer side of the fibre ring.

In view of the above, Japanese patent specification No. 52-12292 teaches to form a fibre sliding wall surface of the spinning rotor, along which fibres slide to the maximum diameter region, so as to have a stepped portion with the aim of causing the impurities to be forcibly separated from the sliding down fibres at the stepped portion and to be fed into an inner region in front of the ring of fibres collected in the fibre collecting groove. Such a spinning rotor somewhat exhibits an impurity rolling-in function, although not sufficient.

With consideration for these circumstances, the inventor of the present invention has sought and found factors causing the impurities once separated from the supplied fibres to be sufficiently rolled into the ring of fibres in the fibre collecting groove.

The first factor is to cause the impurities once separated at the stepped portion of the fibre sliding wall surface to directly adhere to and/or move closely adjacent to the inner side of the fibre ring. The second factor is that even the impurities carried onto the outer side of the fibre ring, i.e., the maximum diameter region are to be rolled into the fibre ring. The last factor is to cause micro-impurities, which stall before abutting against the fibre sliding wall surface and deposit on the bottom of the spinning rotor, to directly adhere to and/or move closely adjacent to the inner side of the fibre ring.

Various designs of a spinning rotor have higherto been proposed to prevent the impurity accumulation. However, none of the prior art spinning rotors have been designed with due consideration for the abovementioned factors, and they do not exhibit a sufficient self-cleaning capability.

It is accordingly a principal object of the present invention to provide an open end rotor for a spinning machine, which is free from an accumulation of impurities in a fibre collecting region of the spinning rotor to allow a continuous high speed spinning operation for a long duration without a yarn quality reduction.

SUMMARY OF THE INVENTION

According to the present invention, there is provided an open end rotor for a spinning machine generally comprising a rotary chamber concentrically disposed about a rotational axis with an open end and an axially spaced closed end, a first circumferential sliding wall extending from the open end radially outwardly from the rotation axis and toward the closed end, and a second annular wall extending from the closed end radially outwardly from the rotational axis and toward the sliding wall to define a fibre collecting space between the first and second walls. The first wall comprises an inner and an outer portion, an angle of 10° to 35° being formed between the inner portion and a straight line extending inwardly from the outer portion so that impurities separated at the junction between the inner and outer portions are directed to a most favourable position within the fibre collecting region, in which position the impurities are allowed to directly adhere to a ring of fibres or to a position closely adjacent to the fibre ring.

Further, even impurities deposited on the outer side of the fibre ring are allowed to be rolled into the fibre ring when the same is twisted into a tail end of yarn. The second wall also comprises an inner portion and an outer portion, an angle of 20° to 50° being formed between the outer portion of the second wall and a straight line extending from the inner portion of the second wall so that micro-impurities deposited on the closed end are also directed to said most favourable position.

BRIEF DESCRIPTION OF THE DRAWINGS

This invention will become more readily apparent from the following description of a preferred embodiment thereof shown, by way of example only, in the accompanying drawings, wherein.

DESCRIPTION OF THE PREFERRED EMBODIMENT

Figure 9:
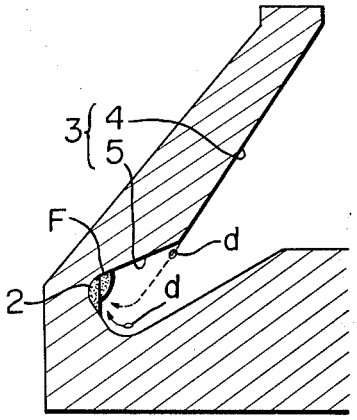
FIG. 9 is a fragmental sectional view showing a typical prior art spinning rotor.

Referring to FIG. 9, there is shown an open end spinning rotor disclosed in the aforesaid Japanese patent specification No. 52-12292 assigned to the same assignee as the present application, wherein an annular fibre sliding wall 3, onto which separated fibres are first supplied through a not shown fibre supply tube, is composed of first and second walls 4, 5 forming a stepped portion at the junction therebetween so that impurities d are effectively separated thereat from the fibres by utilizing a differential force of inertia applied thereon. In this spinning rotor, the fibres are guided into a fibre collecting region 2 while sliding down along the first and second walls 4, 5. Regarding the impurities d, it is expected that they leave the sliding wall 3 substantially at the aforementioned junction and run out into a space below the second wall 5 to be rolled in a ring of fibres F. However, a considerable amount of impurities d become deposited in the maximum diameter or narrowest region on the outer side of the fibre ring F (lefthand side in FIG. 9) during the duration of spinning operation.

The inventor of the present invention has sought and found necessary factors to prevent such an unfavourable accumulation of impurities in the region of maximum diameter.

Figure 1:
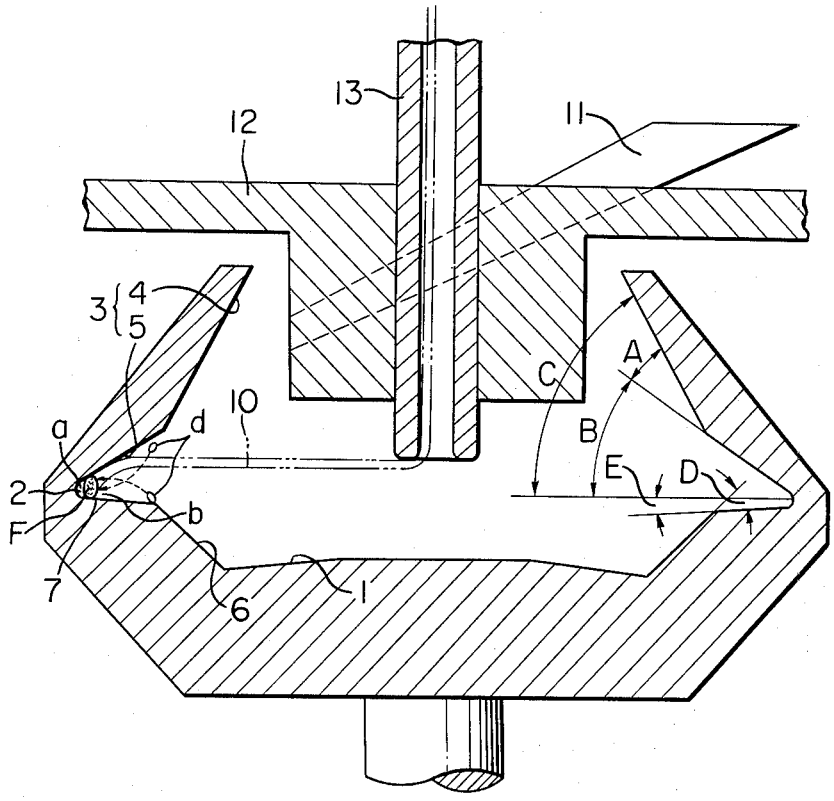
FIG. 1 is a cross-sectional view of an open-end spinning rotor according to the present invention.

Referring to FIG. 1, there is shown an open end rotor constructed according to the invention, wherein a fibre sliding wall 3 is composed of a first inner wall 4 and a second outer wall 5 as in the prior art spinning rotor disclosed in the aforementioned Japanese patent specification, because the concept, that the impurities run out at the junction between the first and second walls 4, 5 toward the inner side of the fibre ring, is effective to prevent the accumulation of the impurities.

In FIG. 1, the spinning rotor of a forced air discharge type comprises a rotary chamber concetrically disposed about a rotational axis with an open end and an axially spaced closed end or bottom 1, a circumferential sliding wall 3 extending from the open end radially outwardly from the rotational axis and toward the closed end 1, an annular guide wall extending from the closed end 1 radially outwardly from the rotational axis and toward the sliding wall 3 to define a fibre collecting space 2 between the sliding wall 3 and the guide wall. The sliding wall 3 comprises a first inner wall 4 and a second outer wall 5, an angle A being formed between the first wall 4 and a straight line extending inwardly from the second wall 5. The second sliding wall 5 forms an angle B with a horizontal plane. The first sliding wall 4 forms an angle C with the horizontal plane. Also, the guide wall comprises a first inner wall 6 and a second outer wall 7, an angle D being formed between the second outer wall 7 and a straight line extending radially outwardly from the first guide wall 6. The second guide wall 7 forms an angle E with the horizontal plane. The angle C is limited to 55°~75° in order that the sliding speed of the fibres directed toward the fibre ring in the collecting space 2 can be maintained at a desirable level. The angle C not being within the limits 55° to 75° causes the fibres to be deposited in a yarn in a random arrangement, resulting in a quality reduction.

With respect to the fibres, in operation, they are fed in separated form through a fibre supply tube 11 into the open end of the rotary chamber and become deposited by centrifugal force on the sliding wall surface 3 and slide to the fibre collecting space 2, still under the influence of centrifugal force, from which they are picked off by a tail end 10 of yarn while contacting the second sliding wall 5. The tail end 10 of yarn is continuously withdrawn from the rotor through a yarn discharge pipe 13 projecting through a cover 12 into the rotary chamber coaxially of the axis of rotation of the rotor.

Regarding the impurities d separated from the fibres at the junction between the first and second sliding walls 4, 5, it is found that, to prevent them from being deposited on the outer side a of the fibre ring, they have to adhere to the inner side surface b of the fibre ring before they enter the fibre collecting space 2. For this purpose, it is required that the angle A be within such limits that the impurities are fed to an optimum position where they are caused to directly adhere to and/or to position closely adjacent the inner side b of the fibre ring F, whereby the impurities d are caused to enter the fibre ring F by the action of centrifugal force. In the case of the angle A being above such limits, it is expected that not only the impurities d will be directed to an unfavourable place far remote from the inner side surface b of the fibre ring F, but also the fibre arrangement in the yarn will be disturbed, although effective for the separation of the impurities d from the discrete fibres. And, in the case of the angle A being below such limit, a considerable amount of impurities d will be brought into the fibre collecting space 2 together with the fibres.

Even if the angle A is so selected, there is somewhat a possibility that the impurities d enter the fibre collecting space 2, i.e., on the outer side a of the fibre ring F. According to this invention, it is found that even these impurities d can be rolled into the fibre ring F by expanding a twisting-in region wherein the fibre ring F is twisted in the fibre collecting space 2.

Figure 2:
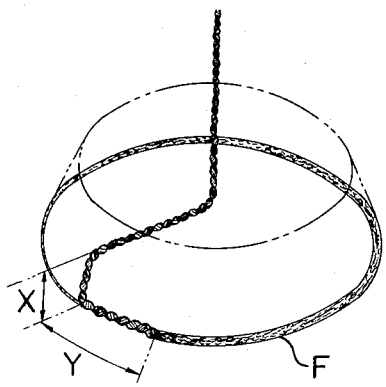
FIG. 2 is a perspective view illustrating a distribution of twisting-in regions wherein a ring of fibres is twisted in a tail end of yarn.
Figure 3:
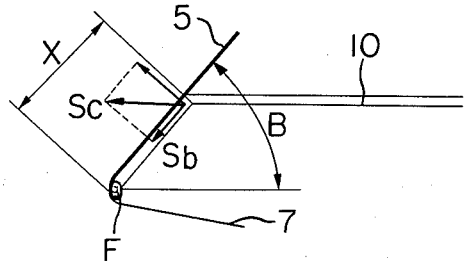
FIGS. 3 and 4 are diagrammatic views illustrating a change in length of twisting-in regions when an angle between a sliding wall and a plane of rotation of the spinning rotor changes.
Figure 4:
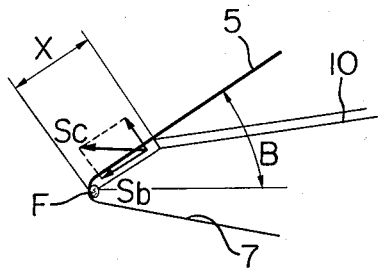

In FIGS. 2 to 4, a twisting-in region can be divided into a region X ranging from a position at which the fibre ring F leaves the fibre collecting space 2 to a position at which the fibre ring F leaves the sliding wall 3 and connects with the yarn tail end, and a region Y wherein the fibre ring F is still in the fibre collecting space 2. Although the whole twisting-in region is defined naturally by spinning conditions, the region X on the second sliding wall 5 can be adjusted in length by varying the angle B, because a component of force Sb in the direction along the second sliding wall 5 changes with the angle B even when the centrifugal force Sc is constant. It is understood from FIGS. 3 and 4 that the smaller the angle B of the second sliding wall 5 is, the larger the component of force Sb becomes, and the closet is the position at which the fibre ring F leaves the sliding wall 5 to the fibre collecting space 2, resulting in a decreased length of the region X. Further, the larger the angle B is, the smaller the component of force Sb becomes, resulting in an increased length of the region X. Thus, by decreasing the angle B, the region X can be decreased in length and the region Y increased in length. This means that an increased twisting action can be imparted to the fibre ring F present in the fibre collecting space 2 to increase the possibility that the impurities d on the outer side a are rolled into the fibre ring F.

From the foregoing description relating to the angles A and B, it is understood that the angles A and B must be compatible with the aforementioned requirements that the impurities d leaving the junction between the walls 4 and 5 be moved to the aforementioned optimum position and that the impurities d present on the outer side a of the fibre ring F be rolled into the fibre ring F.

Various spinning rotors have hitherto been proposed, which show angles corresponding in position where they are formed, but not in value, to the angles A and B obtained according to the present invention. For example, U.S. Pat. No. 3,822,541 discloses an open end rotor, in which the diameter of a fibre collecting groove is selected to be at least eleven times greater than the height of the rotor open end above the base of the groove so as to cause impurities to be carried out of the rotor by an air flow. An angle of 50° corresponding to the angle A is not only determined without the aforementioned factors or requirements in view, but also is so great that the impurities leaving the sliding wall can not reach the aforementioned optimum position. Also, such an excessive angle causes the fibres to be deposited in the yarn in a more or less random arrangement.

U.S. Pat. No. 4,058,964 shows an open end rotor having a fibre collecting groove formed by two surfaces which define an angle of aperture $\alpha$ from 45° to 90°. The bottom of the groove is of a radius of from 0.1 to 0.5 millimeters, and the bisector of the angle of aperture $\alpha$ forms an angle $\beta$ with the plane of rotation of the groove of a value from 0° to 45° while the yarn take-off direction forms an angle with the plane of rotation of from 0° to 25°. These values are also not determined with consideration for the aforementioned factors, and U.S. Pat. No. 4,058,964 does not refer to the angle A at all.

U.S. Pat. No. 3,520,122 discloses a spinning rotor which can compact fibres before being twisted into a yarn. The above comparative explanation regarding U.S. Pat. No. 3,822,541 is also applicable to the spinning rotor of U.S. Pat. No. 3,520,122.

U.S. Pat. No. 3,812,667 discloses a spinning rotor in which fibres are collected in the form of a triangle to make it easy to twist the collected fibres. The comparative explanations with respect to U.S. Pat. Nos. 3,822,541 and 4,058,964 are also applicable to the spinning rotor of U.S. Pat. No. 3,812,667.

Figure 5:
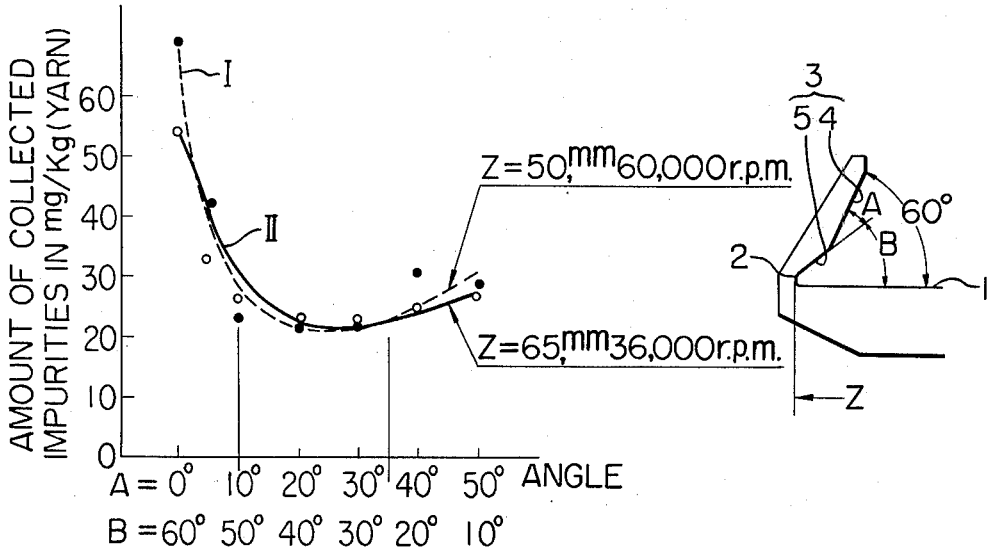
FIG. 5 is a view explaining a change in the amount of collected impurities when an angle A varies.

With the aforementioned factors or requirements in view, the inventor of this invention has attempted many experiments for spinning rotors having the angle C of, for example, 60°. The results of the experiments are illustrated in FIG. 5, from which it will be understood that a curve I relating to a rotor having a maximum inner diameter Z=50 mm, an open end diameter of 40 mm and an outer diameter of 46 mm of the annular first guide wall 6 and rotated at a speed of 60,000 rpm shows substantially the same tendency as a curve II relating to a rotor having a maximum inner diameter Z=65 mm, an open end diameter of 53 mm and an outer diameter 61 of the annular first guide wall 6 and rotated at a speed of 36,000 rpm. It is further understood that by providing the angle A the amount of collected or accumulated impurities can be greatly decreased as compared with the known rotor wherein the angle A=0°, and when the angle A exceeds 35° the amount of accumulated impurities becomes increased. Such an increase of accumulated impurities is considered to be due to the fact that in the case of the angle A in excess of 35° the impurities separated from the discrete fibres at the junction between the first and second sliding walls 4, 5 can not be moved to the aforementioned optimum position on the inner side b of the fibre ring F and that the impurities d present on the outer side a of the fibre ring F can not be caught by or rolled into the fibre ring F.

It is therefore apparent from FIG. 5 that the angle A should be limited to 10°~35°, preferably to 25°. In addition, in the case of the angle A in excess of 35°, the fibres sliding down along the first sliding wall 4 are apt to leave the second sliding wall 5 or otherwise they will abruptly turn at the junction from the first wall 4 to second wall 5. This causes the fibres to be deposited in the fibre ring F in a random arrangement, resulting in a poor yarn quality.

Figure 7:
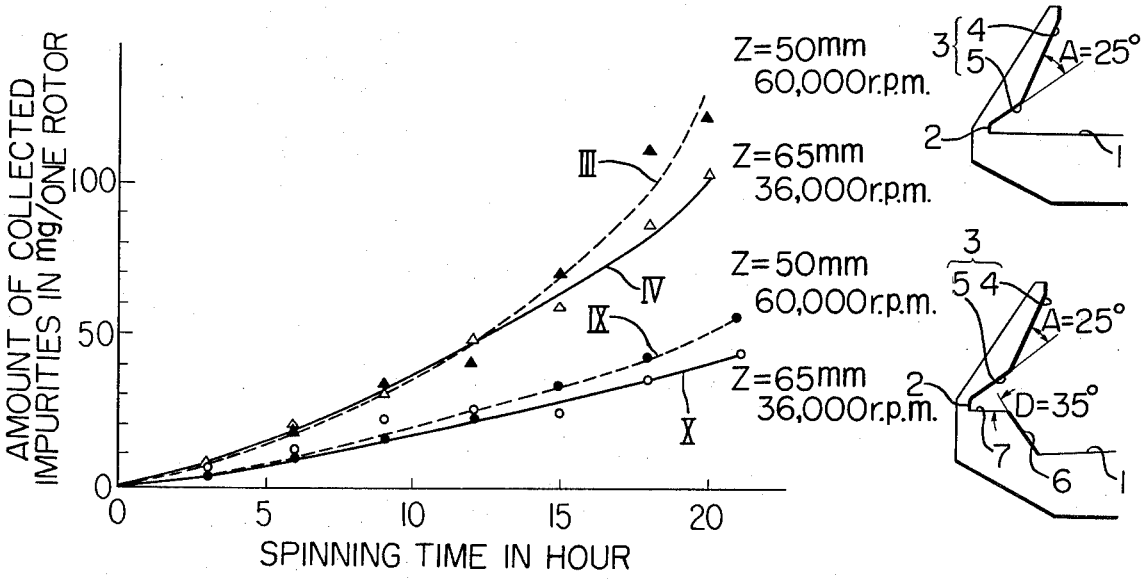
FIG. 7 is a view explaining a difference in the amount of collected impurities between a rotor formed with the angle A and a rotor with both the angles A and D.

Curves III and IV in FIG. 7 show accumulated impurities versus spinning time characteristics of rotors having the angle A of 25°. In these rotors, the amount of accumulated impurities after 20 hours exceeds 100 mg per rotor. The amount of accumulated impurities to this extent does not adversely affect yarn quality and the Lea strength can be maintained within allowable limits even after 20 hours as appreciated from curves V and VI shown in FIG. 8. However, these curves III to VI show a tendency that the yarn quality will be adversely affected when the duration of the continuous spinning operation exceeds 20 hours.

In order to further decrease the amount of accumulated impurities, the inventor of this invention has attempted analysis of the impurities accumulated on the outer side of the fibre ring F. As a result, it was found that the impurities, for the most part, are micro-husks, -neps, -fibres and the like (hereinafter referred to as microimpurities). The inventor has further sought and found a factor causing these micro-impurities to be accumulated on the outer side of the fibre ring.

As is known, the discrete fibres are supplied into the spinning rotor at a sufficient initial speed to allow the fibres to reach the first sliding wall. Such a speed also allows impurities having a greater mass than the fibres to abut against the first sliding wall 4. However, the micro-impurities will stall due to their lightness before arrival at the first sliding wall 4, then deposit on the bottom 1 of the spinning rotor, and slide radially outwardly therealong to the fibre collecting space 2 under the influence of centrifugal force. And, it seems that the increase twisting-in region Y is limited in its function to cause the impurities to be rolled into the fibre ring F. In view of the above, it is understood that to further diminish the amount of accumulated impurities to a minimum, the micro-impurities moving toward the fibre collecting space 2 along the bottom 1 must be re-mixed with the fibre ring F before entering the fibre collecting space 2. According to this invention, such a re-mixing of the micro-impurities is carried out in accordance with the concept that the micro-impurities jump at the junction between the first and second guide walls 6, 7 toward an optimum position where they can directly adhere and/or closely approach to the inner side b of the fibre ring F.

Referring again to FIG. 1, for this object, the angle D is provided between the second guide wall 7 and the straight line extending from the first guide wall 6. The value of the angle D is very important to cause the micro-impurities to jump into the aforementioned optimum position. Because the second guide wall 7 has to form the fibre collecting space 2 in cooperation with the second sliding wall 5, the angle E is allowed to vary within narrow limits. In the case where the angle included between the walls 5 and 7 is too small, there is the danger that large impurities will become mired and caught in the narrowest portion of the fibre collecting space 2. Therefore, the angle E—this is provided to prevent such a miring—is limited to 5°~10°. In any case, it is expected that the micro-impurities sliding along the bottom 1 can be moved toward the inner side b of the fibre ring by jumping at the junction between the first and second guide walls 6, 7, if the angle D is within suitable limits.

Figure 6:
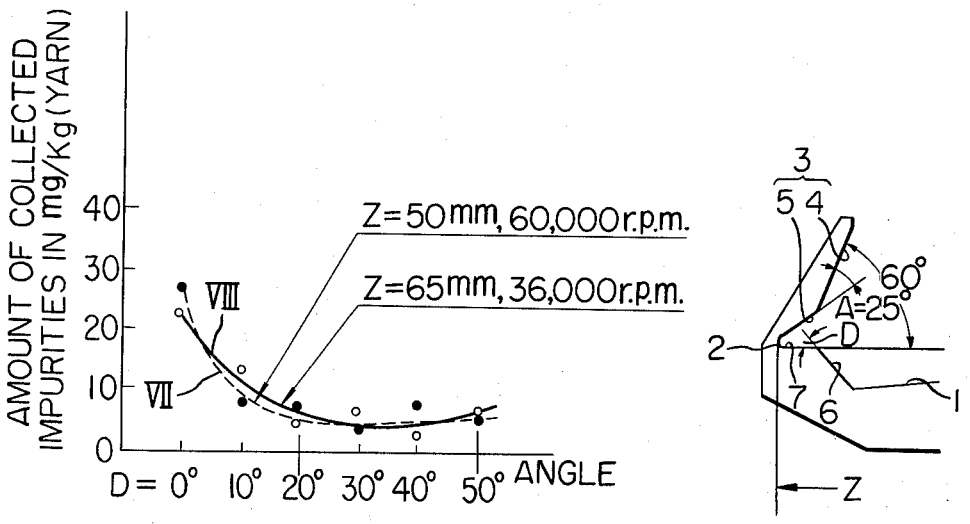
FIG. 6 is a view explaining a change in the amount of collected impurities when an angle D varies.

FIG. 6 shows amount of accumulated impurities versus angle D characteristics (VII and VIII) obtained by experiments using a rotor of angle A=25°, maximum inner diameter Z=50 mm and rotational speed 60,000 rpm, and a rotor of angle A=25°, maximum inner diameter Z=65 mm and rotational speed 36,000 rpm. It is understood from the curves VII and VIII that the amount of accumulated impurities in these rotors decreases with an increase of the angle D. This means that the more the angle D approaches to 0°, the more the micro-impurities enter the fibre collecting space 2 because they are less likely to jump at the junction between the walls 6, 7. It is expected that the micro-impurities will slide along the second guide wall 7 and into the fibre collecting space 2 through any clearance between the underside of the fibre ring F and the second guide wall 7 under the influence of centrifugal force, and that their rolling-in into the fibre ring would be rather difficult because of their lightness and smallness. It is further understood that the increased angle D, especially within the limits 20° to 50°, causes the micro-impurities to fly along a path shown by the dotted line in FIG. 1 so that they directly adhere to and/or reach closely adjacent to the inner side b of the fibre ring, allowing them to be rolled into the sliver and resulting in a smaller accumulation. As is apparent from comparison a between FIGS. 5 and 6, the amount of accumulated impurities was decreased to a fraction of that accumulated in the rotor having an angle D=0° (FIG. 5). Although the amount of accumulated impurities was not so much increased even in the case of an angle D in excess of 50°, such an excessive angle is unfavourable because there is a tendency to cause the micro-impurities to stop on their way to the junction between the first and second guide walls 6, 7 and to develop into a lump, which leaves the guide wall 6 and jumps into the sliver, resulting in a yarn quality reduction. Thus, the angle D should be limited to 20°~50°, preferably to 35°.

Figure 8:
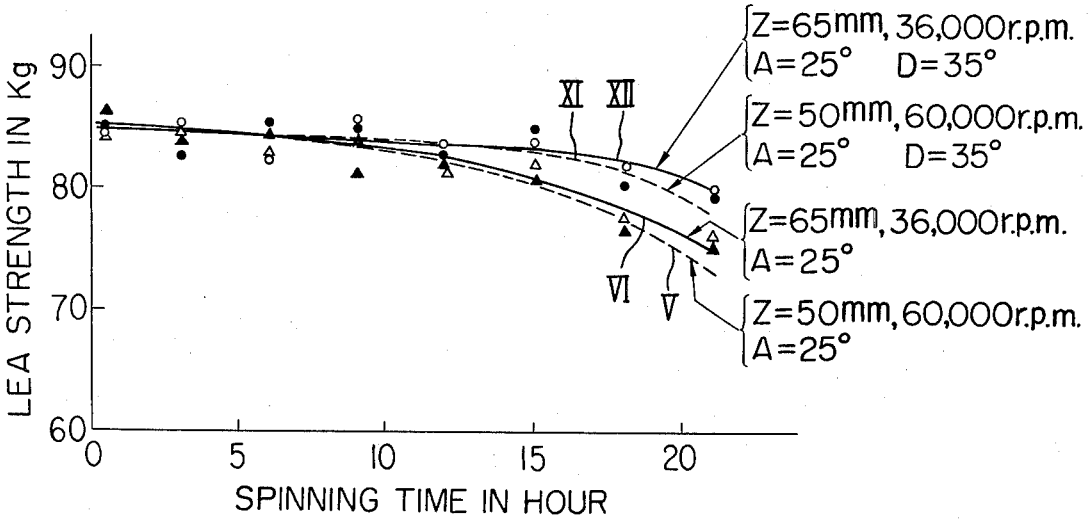
FIG. 8 is a view explaining a difference in Lea strength between yarns produced by the rotors of FIG. 7.

Curves IX and X in FIG. 7 represent amounts of accumulated impurities versus spinning time characteristics obtained by using a rotor of angle A=25°, angle D=35°, maximum inner diameter Z=50 mm and rotational speed 60,000 rpm and a rotor of angle A=25°, angle D=35°, maximum inner diameter Z=65 mm and rotational speed 36,000 rpm. As is apparent from the curves IX and X, the amount of accumulated impurities was greatly decreased in comparison with the rotors wherein the angle D=0° (see curves III and IV). Curves XI and XII in FIG. 8 represent Lea strength versus spinning characteristics obtained by using the same rotors as those used to obtain the curves IX and X. From FIG. 8, it is understood that yarns produced by the rotors having angles A=25° and D=35° can be improved in the Lea strength as compared with the yarns produced by the rotors of angle D=0°.

Although the abovementioned U.S. Pat. No. 4,058,964 of Stalder shows an angle corresponding in position where it is formed, but not in value, to the angle D according to this invention, there is no explanation in the specification with respect to such an angle. That is, Stalder does not teach the concept of this invention at all. The same is also applicable to the spinning rotor shown in the aforementioned U.S. Pat. No. 3,520,122.

It is therefore understood that the present invention has provided an open end rotor for a spinning machine which is free from an accumulation of impurities in a fibre collecting region of the spinning rotor to allow a continuous high speed spinning operation for a long duration without a yarn quality reduction.

While the invention has been described with respect to an open end rotor of the forced air discharge type, it is of course applicable to a rotor of the self-air discharge type with the same effects.

What I claim is:

1. An open end rotor for a spinning machine, said rotor comprising:

a rotary chamber concentrically disposed about a rotational axis and having an open end and a closed end axially spaced from said open end;

a first annular wall extending from said open end radially outwardly from said rotational axis and toward said closed end, said first wall having an inner portion onto which discrete fibres are supplied through said open end and forming a first angle of 55° to 75° with a plane perpendicular to said rotational axis, and an outer portion receiving the fibres from said inner portion, said inner portion forming a second angle of 10° to 35° with a straight line extending from said outer portion;

a second annular wall extending from said closed end radially outwardly from said rotational axis and toward said outer portion of said first annular wall, said second annular wall having an inner portion and an outer portion, said outer portion of said second annular wall forming a third angle of 20° to 50° with a straight line extending from said inner portion of said second annular wall;

said outer portion of said second annular wall defining a fibre collecting space in cooperation with said outer portion of said first annular wall, the fibres being collected into said fibre collecting space while sliding down along said inner and outer portions of said first annular wall;

the thus collected fibres being removed in contact relationship with said outer portion of said first annular wall by twisting them into a tail end of a yarn which is continuously withdrawn from a yarn discharge pipe projecting through said open end into said rotary chamber;

said second angle and the juncture between said inner and outer portions of said first annular wall comprising means for causing heavier impurities, supplied with said fibres onto said inner portion of said first annular wall, to, under the influence of centrifugal force, separate from said fibres and said first annular wall and to be fed to the inner side of said collected fibres in said fibre collecting space; and said third angle and the juncture between said inner and outer portions of said second annular wall comprising means for causing lighter impurities, deposited on said closed end of said rotary chamber, to, under the influence of centrifugal force, separate from said second annular wall and to be fed to said inner side of said collected fibres in said fibre collecting space.

2. A rotor as claimed in claim 1, wherein said outer portion of said second annular wall forms a fourth angle of 5° to 10° with the horizontal plane.

3. A rotor as claimed in claims 1 or 2, wherein said second angle formed between said inner portion of said first annular wall and said straight line extending from said outer portion of said first annular wall is 25°.

4. A rotor as claimed in claims 1 or 2, wherein said third angle formed between said outer portion of said second annular wall and said straight line extending from said inner portion of said second annular wall is 35°.

5. A rotor as claimed in claims 1 or 2, wherein said yarn discharge pipe extends into said rotary chamber to a position such that said tail end of said yarn is free of contact with any surfaces of said rotor between said outer portion of said first annular wall and said yarn discharge pipe.

* * * * *